United States Patent [19]

Reeher et al.

[11] 4,075,479

[45] Feb. 21, 1978

[54] FOCUSING ION LENS SYSTEM FOR MASS SPECTROMETER FOR SEPARATING CHARGED AND NEUTRAL PARTICLES

[75] Inventors: John R. Reeher; Michael S. Story, both of Los Gatos, Calif.; Ronald D. Smith, Bovingdon, England

[73] Assignee: Finnigan Corporation, Sunnyvale, Calif.

[21] Appl. No.: 664,047

[22] Filed: Mar. 4, 1976

[51] Int. Cl.[2] ..... H01J 39/34

[52] U.S. Cl. ..... 250/281; 250/292

[58] Field of Search ..... 250/292, 281, 282, 283, 250/294

[56] References Cited

U.S. PATENT DOCUMENTS

| | | | |
|---|---|---|---|
| 3,859,226 | 1/1975 | Schillalies | 250/292 |
| 3,939,344 | 2/1976 | McKinney | 250/292 |

*Primary Examiner*—Craig E. Church

*Attorney, Agent, or Firm*—Flehr, Hohbach, Test, Albritton & Herbert

[57] ABSTRACT

In a mass spectrometer a focusing ion lens system effectively separates charged from neutral particles by forming a potential well along the axis from the ionizing region to the mass analyzer by the use of a gridded lens system. The grids by the use of a high-low voltage combination form the potential well while at the same time allowing nonselected neutral particles to pass through the grid. Thus, the system is very effective for relatively high pressure ionizing regions where a large amount of neutral particles are generated.

3 Claims, 3 Drawing Figures

FOCUSING ION LENS SYSTEM FOR MASS SPECTROMETER FOR SEPARATING CHARGED AND NEUTRAL PARTICLES

BACKGROUND OF THE INVENTION

The present invention is directed to a focusing ion lens system for mass spectrometer for separating charged from neutral particles.

Normally, a mass spectrometer is used in conjunction with an ionizer where the ions originate under low pressure conditions such as $10^{-3}$ torr. However, recently developed techniques of ionizing sample molecules involve operation of the ionizer at elevated pressures of, for example, greater than $10^{-2}$ torr. This is done in order to utilize the resultant collisions of sample molecules with ionized reagent gas molecules as a means of ionizing the sample molecules. Such operation will produce a mixture of positive and negative ions, electrons and neutral particles.

In order to separate the positive or negative ionic particles from the abundant neutral particles emanating from such a high pressure ion source and subsequently focus the resultant ion beam into a mass analyzer the following has been done in the prior art. Specifically, in most mass spectrometers equipped with a high pressure ionizer a differentially pumped vacuum system is employed so that the ionizer is pumped separately from the mass analyzer and detector. This arrangement allows a lower pressure to be maintained in the vicinity of the mass analyzer. A differential pumping baffle is maintained between the mass analyzer and the ionizing region. However, in order for the low pressure to be maintained in the mass analyzer the bulk of the gas leaving the ionizer must be pumped away by the ionizer pump. It is desirable to retain the ionic particles of interest and focus them into the mass analyzer. This has been accomplished in the past by narrowing the outlet of the ionizing region with subsequent loss of ionic species.

OBJECTS AND SUMMARY OF THE INVENTION

It is, therefore, an object of the present invention to provide a mass spectrometer having a focusing ion lens system which efficiently separates charged and neutral particles.

It is another object of the invention to provide a system as above which can be used for ionizing regions of relatively high pressure.

In accordance with the above objects there is provided a mass spectrometer having an inlet system for admitting samples to be characterized, means for ionizing the samples to produce charged and neutral particles, a mass analyzer and lens means for focusing the resultant ions into the mass analyzer. The lens means is comprised of a plurality of conductive lens elements at least one element having gridded sides in the direction of the axis toward the mass analyzer the lens means forming a potential well along the axis. Selected charged particles are focused into the mass analyzer while allowing the remaining particles to escape through the openings in the conductive grids.

DETAILED DESCRIPTION OF THE PREFERRED EMBODIMENTS

Figure 1:
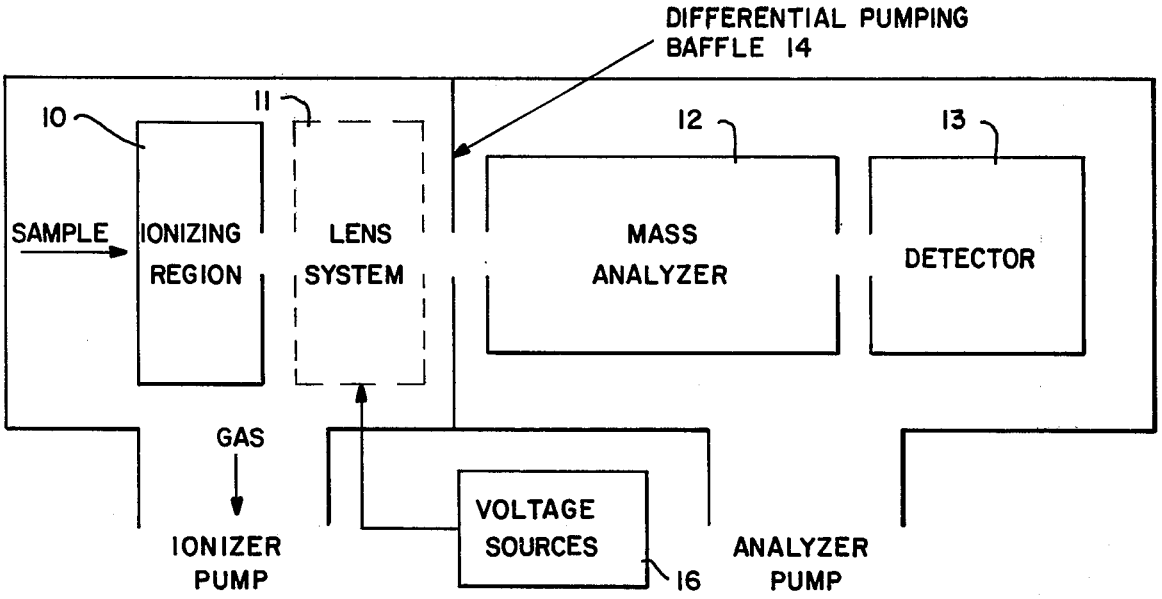
FIG. 1 is a diagrammatic representation of a spectrometer employing the present invention.

Referring now to FIG. 1, an inlet system allows a sample to be placed in the ionizing region 10 where it is ionized to form ions for later characterization by the mass analyzer. In one preferred embodiment of the invention the pressure in the ionizing region is a relatively high pressure, that is, greater than $10^{-2}$ torr, in order that the ionizing procedure forms positive and negative ions. A lens system 11 focuses the selected negative or positive particles (depending on the polarity of the lens system) into the mass analyzer 12. Such ions are separated in accordance with well-known theory and detected by detector 13. The differential pumping baffle 14 allows the mass analyzer region to operate at a much lower pressure, for example, of less than $10^{-3}$ torr than the ionizing region 10. Separate pumps are provided for each section designated ionizer pump and analyzer pump. Voltage sources 16 provide various voltages to lens system 11 as will be described below.

Figure 2:
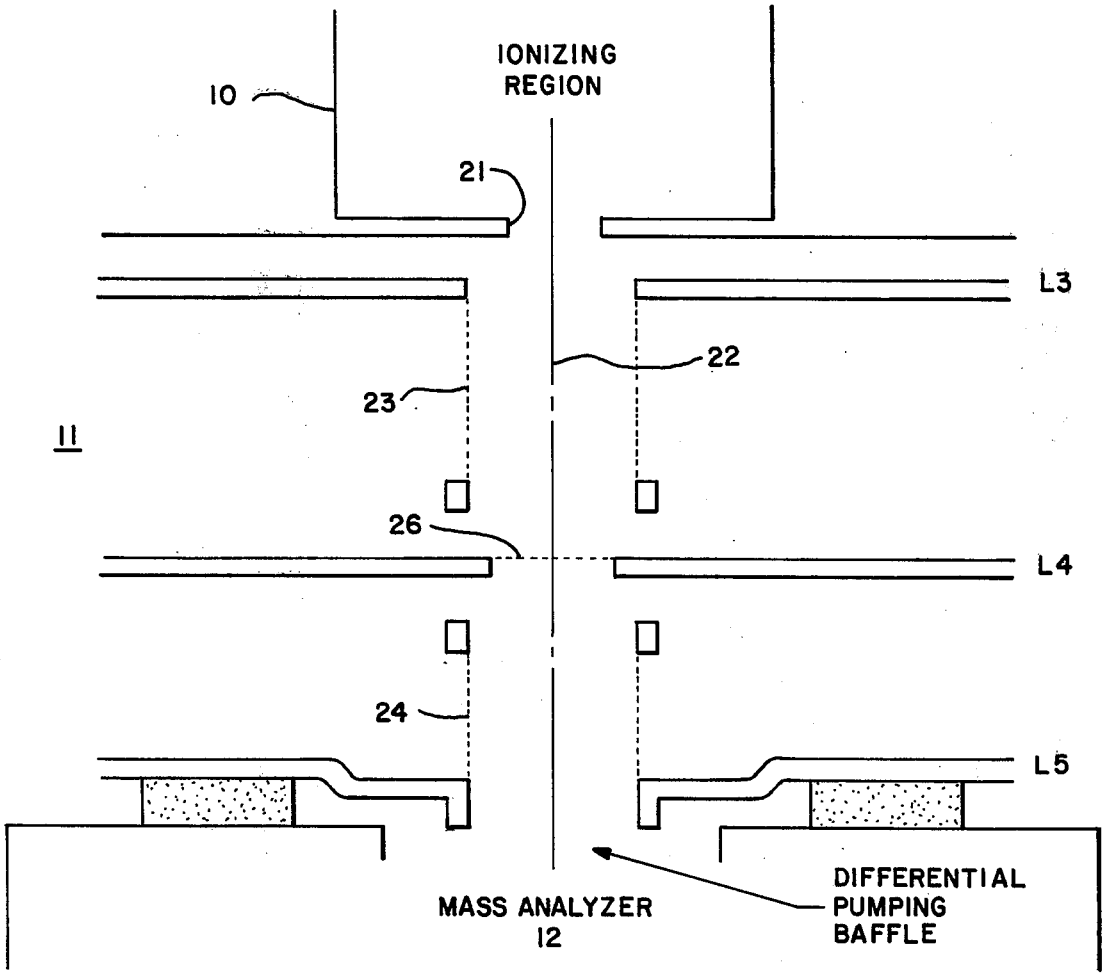
FIG. 2 is a simplified cross-sectional view of a portion of FIG. 1 which illustrates one embodiment of the invention.

Referring now to FIG. 2 this illustrates a lens system 11 useful where the ionizing region is of relatively high pressure. Ionizing region 10 has an aperture 21 through which ions are injected along the axis 22 to the mass analyzer 12. In general the lenses $L_3$, $L_4$ and $L_5$ provide a potential well for a selected positive or negative particle along the axis 22 and focuses this selected charged particle into the mass analyzer while allowing the remaining particles to randomly diffuse outwardly away from the axis 22. Specifically, $L_3$ and $L_5$ include right cylindrical conductive gridded lens portions 23 and 24, respectively, which have their axes coincident with axis 22 and lens $L_4$ includes a conductive gridded plate 26. All of the grids are 92% open with 70 lines per inch in a square pattern. The grids are of nickel material and are electro-formed.

Typical potentials in the case where positive ions are being selected are $L_4$ −50 to −100 volts, $L_5$ −7 to −20 volts and $L_3$ −25 to +10 volts. In the case of $L_3$ the potential is dependent on the pressure in the ionizing region 10. If there is a high pressure with a relatively high flow then a more positive voltage is used and vice versa.

It is apparent that a high-low voltage configuration is used where the intermediate gridded plate 26 has a relatively high potential with lower potentials on either side for the gridded cylinders 23 and 24. This, thus, provides a potential well for the selected positive ions and the nonselected negative particles are allowed to escape through the 92% open grids. Of course, in the case where it is desired to selected a negative ion, the foregoing potentials would be reversed. This would also select electrons, but these are easily filtered by the mass analyzer.

In view of the very effective focusing action of the lens system 11, the aperture 21 in the ionizing region 10 may be opened up to allow a greater number of particles of all types to be extracted from the ionizing region. The high conductance of the grids allows the bulk of the gas to escape to the ionizer pump. This is as opposed to the prior art where the lens system allowed the bulk of the gas and ions to escape to the ionizer pump.

Figure 3:
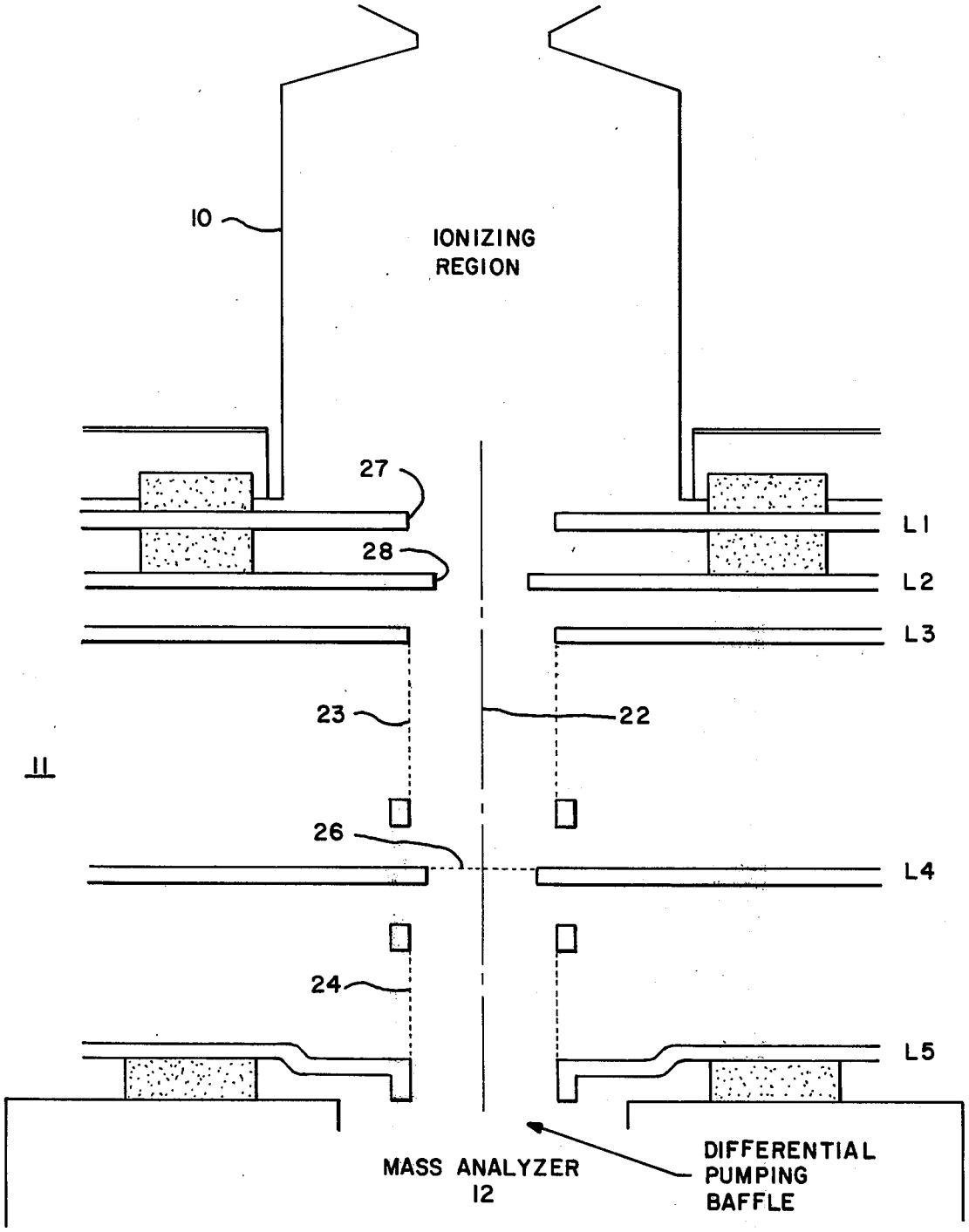
FIG. 3 is a simplified cross-sectional view of a portion of FIG. 1 illustrating another embodiment of the invention.

FIG. 3 illustrates an alternative embodiment which is useful for both high pressure and low pressure operation of ionizing region 10. Instead of an aperture 21 in ionizing region 10 additional lens elements $L_1$ and $L_2$ are substituted. $L_1$ and $L_2$ merely have open apertures 27 and 28. When this lens system is used with a high pressure in the ionizing region the lens elements $L_1$ and $L_2$ are maintained at the same potential as the ionizing region, for example, ground, with $L_2$ fixing the size of the effective ionizer exit aperture for the ions and molecules. The same potentials are applied to the remaining lens elements $L_3$, $L_4$ and $L_5$ as discussed in conjunction with FIG. 2.

However, where it is desired to utilize the apparatus in a low pressure embodiment, that is where the ionizing region is at a pressure of less than $10^{-2}$ torr, the potentials of lens elements $L_1$ and $L_2$ are adjusted to form an extraction field to extract the ionic component of interest from the ionizer and to inject it into the remaining three lens elements $L_3$ through $L_5$. Thus, in this context, the lenses $L_3$ through $L_5$ comprise a modified Einzel lens which focuses the ions into the mass analyzer. Since the lens system works well with both low pressure and high pressure ionizers this makes possible the construction of an ionizer which will function well over a wide pressure range. Typical voltages for the selection of positive ions are the following: $L_1$ $-6$ to $-10$ volts, $L_2$ $-80$ to $-100$ volts, $L_3$ $-10$ volts, $L_4$ $-80$ volts and $L_5$ $-7$ to $-10$ volts. For negative ions these potentials would be reversed.

The effectiveness of the gridded cylindrical lenses for allowing the gas molecules to escape while retaining the ionic component of interest is a function of the transparency and thickness of the grid and the number of lines per inch. Typical parameters have been given above. In principle, the grid should be chosen to be as transparent and thin as possible to allow the neutral particles to escape consistent with keeping as many lines per inch as possible to approximate electrically a solid cylinder for effective focusing of the ionic component of interest.

Although circular cross sections are illustrated, grids with noncircular cross sections may also be suitable such as elliptical, or a grid formed into a truncated cone.

What is claimed is:

1. A mass spectrometer having an inlet system for admitting samples to be characterized, means for ionizing said samples to produce charged and neutral particles, a mass analyzer, and lens means located along an optical axis between said ionizing means and said mass analyzer for focusing the resultant ions into said mass analyzer, said lens means comprising a plurality of conductive lens elements in the direction of said axis said lens means forming a potential well along said axis to focus a selected charged particle into said mass analyzer while allowing the remaining particles to escape whereby a selected charged particle passes directly along said axis from said ionizing means to said mass analyzer said lens means including first and second enclosures having walls substantially transparent to said remaining particles for allowing their escape and separated by a plate substantially transparent to said selected particles, and voltage source means for applying a relatively high voltage to said plate relative to both of said enclosures to form said potential well.

2. A mass spectrometer as in claim 1 where said high voltage is negative to form a potential well for positive ions.

3. A mass spectrometer as in claim 1 where said ionizing region has a relatively higher pressure than said mass analyzer.

* * * * *